US005167735A

United States Patent [19]

Jurmann

[11] Patent Number: 5,167,735

[45] Date of Patent: Dec. 1, 1992

[54] PROCESS FOR THE ANNEALING OF STEEL ANNEALING MATERIAL

[75] Inventor: Alexander Jurmann, Unterhaching, Fed. Rep. of Germany

[73] Assignee: Linde Aktiengesellschaft, Wiesbaden, Fed. Rep. of Germany

[21] Appl. No.: 680,673

[22] Filed: Mar. 28, 1991

[30] Foreign Application Priority Data

Mar. 29, 1990 [DE] Fed. Rep. of Germany ..... 4010102

[51] Int. Cl.[5] ..... C23G 1/00

[52] U.S. Cl. ..... 148/606; 148/621; 148/625; 148/633

[58] Field of Search ..... 148/134, 113, 16, 606, 148/621, 625, 633

[56] References Cited

U.S. PATENT DOCUMENTS

| | | | |
|---|---|---|---|
| 4,116,730 | 9/1978 | Arendt et al. | 148/113 |
| 4,178,194 | 12/1979 | Azzerri et al. | 148/113 |
| 4,186,038 | 1/1980 | Maucione | 148/113 |
| 4,478,653 | 10/1984 | Littmann | 148/112 |

OTHER PUBLICATIONS

Metals Handbook, 9th ed., vol. 5, pp. 3 to 21, 68 to 82.

*Primary Examiner*—R. Dean
*Assistant Examiner*—Sikyin Ip
*Attorney, Agent, or Firm*—Millen, White, Zelano and Branigan

[57] ABSTRACT

For the annealing of steel in continuously operating units, the formation of so-called white dust is almost completely eliminated by subjecting the steel to a deoxidizing pretreatment before the annealing sequence so as to at least largely remove the oxygen adsorbed on the surface of the steel, as well as any oxygen compounds also present on the surface.

19 Claims, 1 Drawing Sheet

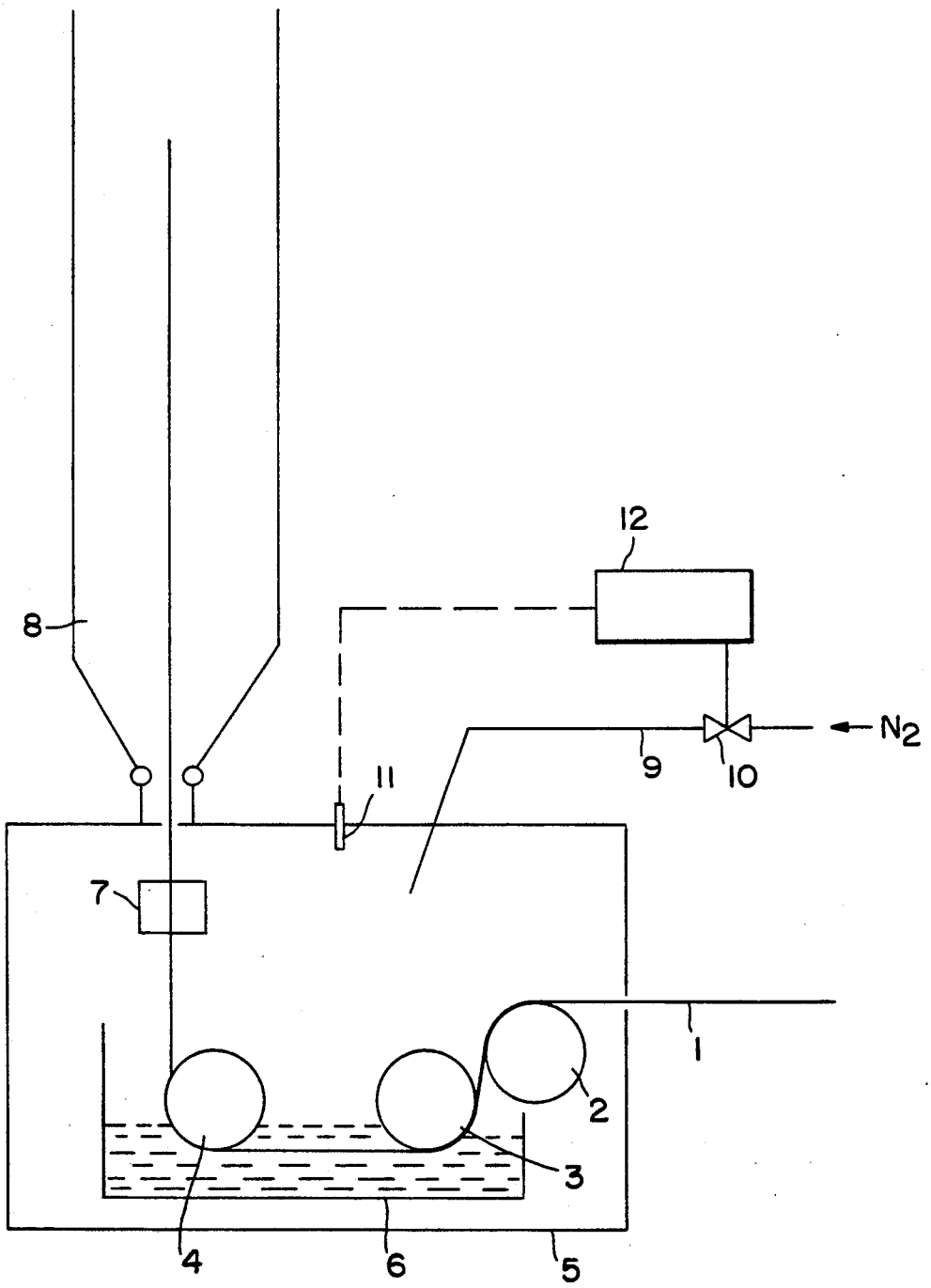
12
8
N2
9
10
11
7
1
2
3
4
6
5

PROCESS FOR THE ANNEALING OF STEEL ANNEALING MATERIAL

BACKGROUND OF THE INVENTION

This invention relates to a process and apparatus for the annealing of steel annealing material, especially high-grade steel, in continuous units under a protective gas, wherein the annealing material in the protective gas atmosphere is successively heated, annealed, and cooled. (By steel annealing material is meant steel in any form which is to be annealed and will be referred to hereinafter as "raw steel").

The annealing of the raw steel is often conducted in a continuous manner in continuous units or a furnace under a suitable protective gas, often under gaseous atmospheres having a relatively high hydrogen concentration. In such a system, a problem exists in that according to new findings, boron contained in the raw steel is oxidized out of it during the annealing process, and the resultant gaseous boron oxide is later precipitated in the form of white dust in the downstream condensers serving to cool the annealed steel. The cooling efficiency of the condensers is so drastically reduced within a period of weeks that the unit has to be shut down so that the condensers can be replaced or cleaned. This leads to a production loss of at least one working day.

The problem of white dust is described, for example, in "Stahl und Eisen" 107 (1987), No. 6, pp. 267–273, especially p. 271, lower right. There, the problem of the heat exchangers clogged by white dust is solved or reduced by providing an installation wherein the heat exchangers can be subjected to a relatively quick cleaning or a quick exchange. Nevertheless, there is a need for further improvement.

SUMMARY OF THE INVENTION

An object of this invention, therefore, is to provide a process and associated apparatus to further reduce or completely eliminate the problem of white dust which leads to production losses in continuous heat treatments.

Upon further study of the specification and appended claims, further objects and advantages of this invention will become apparent to those skilled in the art.

To attain these objects, raw steel is subjected to a deoxidizing pretreatment before the actual annealing sequence, which at least largely removes the oxygen adsorbed on the surface of the raw steel and, optionally, the oxygen compounds present on the surface.

This process is based on recent analyses which indicate that the white dust consists essentially of boron oxides which are formed during the annealing process by the boron in the raw steel reacting with oxygen or compounds of oxygen also present in the annealing unit. This "oxygen supply" in the annealing unit is probably caused by the adsorptive coating of the raw steel with oxygen, as well as by the alloying oxides, e.g., chromium oxides, present in the surface layer, which oxides are especially present in passivated raw steel. Such oxide layers occur particularly on high-grade steel strips. That an undesirably high oxygen supply exists in the annealing unit can be deduced from the fact that, for example, when using a pure hydrogen protective gas atmosphere, the protective gas is fed into the furnace at a water content of approximately 1 vpm (volumes per million), but inside the furnace, the hydrogen contains contents of up to and even more than 30 vpm of $H_2O$. This means that, over and above the oxygen content in the supplied protective gas, additional oxygen comes into the heat treatment unit from another source, specifically, from the surface coating of the raw steel, and this results in a higher water content in the unit.

According to the invention, the increased content of oxygen in the protective gas is prevented by providing a deoxidizing treatment of the raw steel upstream from the annealing operation. The deoxidation of the raw steel can be achieved by various methods, for example, by passage of the steel through an upstream heating chamber having an independent protective gas atmosphere separated from the annealing unit or by passage through a chamber having a low pressure, e.g., not more than 100 mbar.

In an advantageous, highly effective embodiment of the invention, the deoxidizing pretreatment according to the invention comprises subjecting the raw steel in an essentially oxygen-free chamber to a pickling step, followed by cleaning and drying steps.

The pickling step, known from the passivation of steel material, has been shown to be extremely effective for the purposes of the present invention and is economically advantageous, despite the additional expense incurred, since a technologically known process step is involved which, in annealing treatments, is otherwise also performed downstream (see, e.g., "Stahl und Eisen", suora, page 268, point 6).

Conducting the pickling step in an essentially oxygen-free atmosphere thereby avoids the formation of a new coating of oxygen on the raw steel after the pickling step since, after cleaning and drying, the resultant pickled steel is passed directly into an annealing furnace having an essentially oxygen-free atmosphere, i.e., having an oxygen content of no more than 10 vpm (parts per million by volume), e.g., pure hydrogen.

In an advantageous embodiment, the essentially oxygen-free chamber is produced by purging the chamber with an essentially oxygen-free gas, preferably nitrogen or argon because they are inert, relatively trouble-free and inexpensive gases. Essentially oxygen-free purge gases, such as hydrogen, argon and nitrogen, generally obtained from the liquified state usually contain less than 1 vpm oxygen. In this case, an oxygen content of less than 1 vpm is most preferably maintained in the oxygen-free chamber. The oxygen content in the chamber can be monitored by conventional equipment, e.g., comprising an oxygen sensor, which monitors the oxygen content in the treatment chamber and which is connected to a regulator, which regulates the oxygen-free gas supply to the chamber. Preferably nitrogen or argon is used as an oxygen-free gas because of their low cost (especially in comparison with the treatment gas hydrogen) and their inert, noncombustible character.

It has proven to be particularly advantageous if the deoxidizing pickling is performed by passing the annealing material through a conventional or even an electrolytic pickling bath and maintaining an exposure time of at least 3 seconds, preferably 3–10 seconds.

In addition to the pickling step, another especially effective deoxidizing pretreatment comprises subjecting the annealing material to induction heating, preferably in an oxygen-free chamber purged with nitrogen, argon or hydrogen. This process variant is particularly effective where oxygen is predominantly adsorbed on the raw steel, since a thorough desorption of the oxygen can be achieved very rapidly by induction heating, whereby the desorption is supported especially in a reducing hydrogen atmosphere. Such induction heating is used to heat the annealing material to about 600–1,000° C., preferably for a period of about 10–20 seconds.

Annealing apparatus suitable for conducting the process of the invention comprises an essentially sealed chamber provided with a gas feed pipe placed in front of the intake zone in the annealing unit, the chamber containing a pickling bath, a cleaning station, and conveying means for passing the raw steel through the chamber and the treatment stations disposed therein.

For conducting the second process variant, induction heating means is located in a chamber provided for the induction heating of the annealing material; corresponding conveying means are also employed.

This invention is particularly useful for annealing raw steel containing boron, especially in boron-alloyed austenitic steel types.

BRIEF DESCRIPTION OF THE DRAWING

The accompanying drawing is a diagrammatic flowsheet of a preferred embodiment of the invention.

DETAILED DESCRIPTION OF THE DRAWING

In the drawing, the intake area of a strip annealing unit is shown with an upstream deoxidation chamber according to the invention.

Since a strip annealing unit is involved in the continuous annealing unit partially shown in the drawing, the raw steel in the embodiment is a continuous steel strip 1, which is delivered by rollers 2, 3, 4. The steel strip 1 is first passed into a chamber 5 and is deflected there by rollers 2 and 3 so that it is introduced into a pickling bath 6 and then withdrawn after rotation around downstream roller 4. A cleaning station 7 is connected to the pickling bath 6, which is followed by the moving of steel strip 1 from chamber 5 to the actual annealing unit connected by its intake tunnel to chamber 5. Chamber 5 is further filled with a gas feedpipe 9 for nitrogen, a control valve 10, an oxygen measuring instrument 11, and a controller 12 for operating the control valve 10.

The above-mentioned second process variant is provided by modifying the apparatus shown in the drawing by omitting pickling bath 6 and cleaning station 7 and arranging an induction heater approximately between rollers 3 and 4.

To conduct the process according to the invention, nitrogen is fed into chamber 5 through gas feedpipe 9, to displace the air in the cleaning chamber. After the initial displacement of air by purging with nitrogen, the oxygen content in chamber 5 is monitored by an oxygen-measuring instrument 11; and, responsive thereto, the nitrogen feed is regulated by controller 12 to maintain a specific upper limit for the content of oxygen in the chamber, which upper limit is preferably below 1 vpm. This oxygen displacement is used so that a steel strip deoxidized according to the invention in chamber 5 cannot be recontaminated with oxygen or oxygen compounds before the annealing step.

The deoxidation, i.e. the removal of adsorbed oxygen or oxygen compounds present on the surface, occurs in chamber 5, in accordance with the first process variant, by guiding the steel strip 1 through pickling bath 5 disposed within said chamber. A pickling acid, conventionally used in the passivation of steel material, for example, 10% nitric acid, is employed in pickling bath 5. At a residence time of the steel strip in the pickling acid of at least 3 seconds, the oxygen present on the steel strip is reduced sufficiently to substantially reduce the formation of white dust on the cooling surfaces of the condensers (not shown) situated downstream from the annealing unit. Aside from 10% nitric acid, a variety of other known pickling acids can be used, for example, $H_2SO_4$, HCl—also in a dilution range of 3%–10%.

After passing through the pickling bath, the steel strip is passed through a cleaning step to remove the pickle liquor remaining on the strip. This can be achieved by wiping and drying the steel strip or by projecting water jets onto the steel strip, firstly, and then also wiping and drying the strip. The drying step can be carried out essentially oxygen-free with hot gas jets, e.g., hot essentially oxygen-free nitrogen jets, whereby the nitrogen then constitutes a part of the essentially oxygen-free atmosphere in the deoxidizing chamber.

A considerable reduction in the formation of white dust is obtained with the proposed procedure in continuous annealing units, which is advantageous despite the additional expense incurred because it offsets otherwise frequent production losses.

The entire texts of all applications, patents, and publications cited above and below, and of corresponding German Application No. P 40 10 102.9, filed Mar. 29, 1990, are hereby incorporated by reference.

The preceding examples can be repeated with similar success by substituting the generic or specific reaction and/or operation conditions of this invention for those used in the preceding examples.

From the foregoing description, one skilled in the art can easily ascertain the essential characteristics of this invention and, without departing from the spirit and scope thereof, can make various changes and modifications of the invention to adapt it various usages and conditions.

What is claimed is:

1. In a process for the annealing of boron-alloyed austenitic steel wherein the steel is sequentially heated, annealed, and cooled under a protective atmosphere having no more than 10 parts per million by volume of oxygen, the improvement comprising subjecting the steel to a deoxidizing pretreatment before the annealing sequence so as to remove adsorbed oxygen on the surface of the steel and, optionally, compounds of oxygen present on the surface, wherein the deoxidizing pretreatment comprises a pickling step with a following cleaning step for the steel, both the pickling and the cleaning being conducted in a sufficiently and essentially oxygen-free chamber upstream of the annealing stage so as to substantially reduce white dust attributable to gaseous boron oxide.

2. The process of claim 1, wherein the deoxidizing pretreatment comprises a pickling step with a following cleaning step for the steel in an essentially oxygen-free chamber upstream of the annealing stage.

3. The process of claim 1, wherein the oxygen-free chamber is purged with an essentially oxygen-free gas.

4. The process of claim 3, wherein the essentially oxygen-free gas is nitrogen or argon.

5. The process of claim 1, wherein the deoxidizing pickling is conducted by passing the steel through a pickling bath for an exposure time of at least 3 seconds.

6. In a process for the annealing of boron-alloyed austenitic steel wherein the steel is sequentially heated, annealed, and cooled under a protective atmosphere having no more than 10 parts per million by volume of oxygen, the improvement comprising subjecting the steel to a deoxidizing pretreatment before the annealing sequence so as to remove adsorbed oxygen on the surface of the steel, wherein the deoxidizing pretreatment comprises subjecting the steel to induction heating in a sufficiently and essentially oxygen-free chamber upstream of the annealing stage to heat the steel to about 600°-1000° C. so as to substantially reduce white dust attributable to boron oxide.

7. The process of claim 6, wherein the essentially oxygen-free chamber is produced by purging the chamber with an essentially oxygen-free gas.

8. The process of claim 7, wherein the essentially oxygen-free gas is nitrogen, argon or hydrogen.

9. The process of claim 1, wherein compounds of oxygen are present on the surface, and the deoxidizing pretreatment removes said compounds.

10. The process of claim 6, wherein the induction heating is conducted for 10-20 seconds.

11. The process of claim 1, wherein said cleaning step comprises removing pickling liquid from the steel and drying resultant steel.

12. The process of claim 11, wherein said drying is conducted by passing hot, essentially oxygen-free jets onto the steel.

13. The process of claim 12, wherein the oxygen-free jets are oxygen-free nitrogen jets.

14. The process of claim 1, wherein said boron-alloyed austenitic steel subjected to the deoxidizing pretreatment is raw steel.

15. The process of claim 6, wherein said boron-alloyed austenitic steel subjected to the deoxidizing pretreatment is raw steel.

16. The process of claim 1, wherein the deoxidizing pretreatment step is conducted in a chamber maintained at an oxygen level of less than 1 part per million by volume of oxygen.

17. The process of claim 6, wherein the deoxidizing pretreatment step is conducted in a chamber maintained at an oxygen level of less than 1 part per million by volume of oxygen.

18. The process of claim 16, wherein the essentially oxygen-free gas is nitrogen or argon.

19. The process of claim 17, wherein the essentially oxygen-free gas is nitrogen or argon.

* * * * *